United States Patent [19]

Kessel

[11] 4,198,717

[45] Apr. 22, 1980

[54] MODULAR ASSEMBLY FOR DRAIN TRAP

[76] Inventor: Bernhard Kessel, Ingolstädter Str. 20,, 8073 Kösching, Fed. Rep. of Germany

[21] Appl. No.: 894,488

[22] Filed: Apr. 7, 1978

Related U.S. Application Data

[63] Continuation of Ser. No. 688,283, May 20, 1976, abandoned.

[30] Foreign Application Priority Data

May 21, 1975 [DE] Fed. Rep. of Germany ..... 2522424

[51] Int. Cl.[2] ..... E03C 1/28; F16L 5/00

[52] U.S. Cl. ..... 4/286; 4/291; 4/293; 137/247.11; 137/247.27; 137/247.41; 285/189

[58] Field of Search ..... 4/197, 206, 207, 286, 4/290–292, 421, 428, 430, 293, DIG. 7; 210/163–165, 532.5; 137/247.11, 247.15, 247.27, 247.29, 247.35, 247.41, 247.47, 247.43; 248/27.1; 285/189; 403/331, 353

[56] References Cited

U.S. PATENT DOCUMENTS

| | | | |
|---|---|---|---|
| 541,208 | 6/1895 | Knispel | 137/247.11 X |
| 1,456,105 | 5/1923 | Heinkel | 137/247.11 X |
| 2,136,945 | 11/1938 | Klein | 137/247.35 |
| 2,550,400 | 4/1951 | Boosey | 210/163 X |
| 2,665,147 | 1/1954 | Weismann | 285/189 X |
| 2,796,988 | 6/1957 | Löffler | 210/163 X |
| 2,852,140 | 9/1958 | Maclaren | 210/532.5 X |
| 2,938,437 | 5/1960 | Daley | 137/247.27 X |
| 3,066,802 | 12/1962 | Löffler | 210/163 |

FOREIGN PATENT DOCUMENTS

| | | | |
|---|---|---|---|
| 599834 | 5/1932 | Fed. Rep. of Germany | 210/163 |
| 434398 | 2/1912 | France | 210/163 |
| 76164 | 1/1946 | Norway | 137/247.15 |
| 13566 | of 1906 | United Kingdom | 210/163 |

*Primary Examiner*—Stuart S. Levy
*Attorney, Agent, or Firm*—Karl F. Ross

[57] ABSTRACT

A trap to be installed in a wall leading to a drain comprises an assembly of interfitted modular units, molded or deep-drawn from corrosion-resistant synthetic resin, which include an upwardly open housing of rectangular outline, a conduit with a bottom inlet and a lateral outlet removably inserted in that housing, a catch basket receivable in the housing alongside the conduit, a lid for the housing, and a possible extension interposable between the housing and its lid. The inserted conduit may be provided with an externally manipulable shut-off valve between its inlet and outlet, and/or with a hinged flap serving as a check valve; alternatively, it may have an internal tongue designed to raise its liquid level for a more effective stopping of the escape of sewer gases. One or more extensions may be secured to the housing with the aid of external clamps engaging outer peripheral flanges thereof.

12 Claims, 15 Drawing Figures

MODULAR ASSEMBLY FOR DRAIN TRAP

CROSS-REFERENCE TO RELATED APPLICATIONS

This application is a continuation of my application Ser. No. 688,283 filed May 20, 1976, now abandoned, and is related to applications Ser. Nos. 688,282 and 688,309, both also filed May 20, 1976 and since issued as U.S. Pat. Nos. 4,074,686 and 4,092,747, respectively.

FIELD OF THE INVENTION

My present invention relates to a trap for a drain designed to conduct waste water from a sump, gully or the like to a sewer. More particularly, it concerns a modular assembly for building such a trap.

BACKGROUND OF THE INVENTION

Depending upon the type of drain in which a trap is to be installed, as well as upon its environment (e.g. whether it is located in the open or inside a dwelling), different requirements may have to be satisfied. A simple odor trap, for example, need only insure the continuous existence of a pool of water blocking the escape of sewer gases. In cases where backup of sewage is a problem, a manually operable shut-off valve may have to be provided for emergency use. Where the runoff into the trap is essentially from rainwater or melting snow, it may be advantageous to equip the trap with a catch basket for pebbles or the like swept along by the flow. Situations may also arise in which a device of this kind, originally designed just as a collection vessel, may have to be subsequently equipped with an odor-blocking insert or a shut-off valve.

In the case of an outside drain located close to a building wall, a trap needs to be disposed only slightly below the surface unless the precipitation to be carried off by its drain is collected from a larger area by the usual eave gutter and an associated leader terminating at or above that trap. If such a leader is installed after the trap has been emplaced, it may be necesssary to deepen the well in which the trap is located so as to reduce the risk of water accumulation on the surface which could result in the flooding of a nearby doorway. In that instance the pool formed by the trap may have to lie at a level between 1 and 1½ meters below the surface; this makes it difficult to remove the usual lid of the trap in order to gain access to its interior for cleaning or replacing some of its parts.

OBJECTS OF THE INVENTION

The general object of my present invention is to provide a simple and inexpensive modular assembly for such a drain trap which allows these various requirements, including the possibility of subsequent modifications, to be taken into account.

Another object is to provide an assembly of this nature whose components are of light weight and will form fluidtight seals, even after prolonged use, while being resistant to corrosion and easily cleanable from adhering solids.

A more particular object of this invention is to provide a basic housing structure for such a trap which can be fitted with various inserts and attachments to form either an anti-backup trap of the type disclosed in my U.S. Pat. No. 4,074,686 or an odor trap as disclosed in my U.S. Pat. No. 4,092, 747, both referred to above.

SUMMARY OF THE INVENTION

According to an important aspect of my invention, a modular assembly for a drain trap comprises an upwardly open housing having a sidewall provided with an exit port for entering waste water, this sidewall being internally formed below that port with a pocket open toward the top. A tubular insert, having a bottom inlet and a side outlet, has a depending foot portion receivable in the pocket of the housing for juxtaposition with the aforementioned sidewall to align its outlet with the exit port. The sidewall is also provided with ancillary fastening means, such as inwardly projecting screw bolts, engageable with the insert to secure it in cantilevered position to that sidewall.

The housing, advantageously, has a generally rectangular horizontal outline, with a minor side defining the sidewall carrying the exit port. One half of the housing, preferably the one close to this sidewall, accommodates the removable insert while its other half, remote from the sidewall, forms an antechamber for inflowing water. That antechamber, empty or occupied by a removable filter screen such as the above-discussed catch basket, may be overlain by a perforated section of a rectangular lid also having a section provided with a recessed grip above the insert. If the entire lid is perforated, a deflector may be installed above the insert for diverting descending solids to the basket.

According to another aspect of my invention, the top of the housing is internally rabbeted to form a first peripheral seat designed to receive a bottom edge of a shell positionable on the housing as an extension thereof, this shell being internally rabbeted to form a second peripheral seat. A lid, again preferably rectangular and divided into perforated and grip-forming sections, may be received on the second seat or—if the shell is not used—directly on the first seat. The shell can be removably secured to the housing by fastening means such as a set of yoke-shaped clamps engaging superposed outer peripheral flanges of the housing and the shell. With the aid of one or more such extensions, the lid can be easily accessible from above even if the trap housing is sunk deep into the ground.

BRIEF DESCRIPTION OF THE DRAWING

The above and other features of my invention will now be described in detail with reference to the accompanying drawing in which.

SPECIFIC DESCRIPTION

Figure 1A:
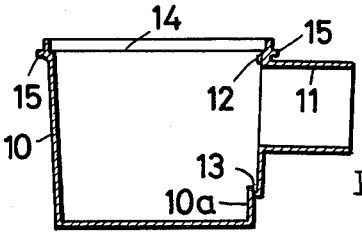
FIG. 1*a* is a longitudinal sectional view of a modular housing for a drain trap according to my invention.

Except for hardware such as clamps and screws, all the components illustrated in the drawing and described in detail hereinafter may be molded or deep-drawn from a tough and corrosion-resistant plastic material such as polyester.

Figure 1B:
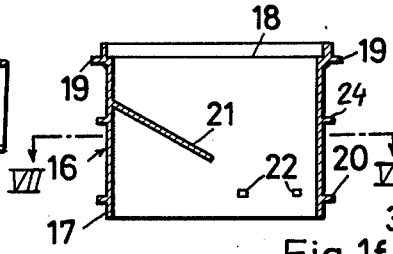
FIG. 1*b* is a similar view of an open-ended shell designed to form an upward extension for the housing of FIG. 1*a;*
Figure 1I:
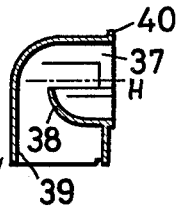
FIG. 1*i* is a view similar to FIGS. 1*f* and 1*h*, illustrating a different insert designed for an odor trap.
Figure 1C:
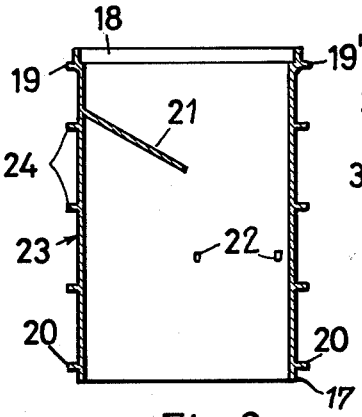
FIG. 1*c* is a view similar to FIG. 1*b,* illustrating a taller shell.
Figure 1D:
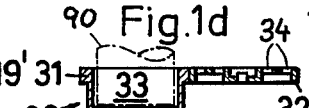
FIG. 1*d* is a longitudinal sectional view of a lid fitting any of the components of the preceding Figures.
Figure 1E:
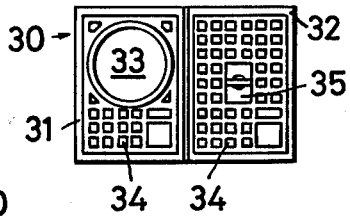
FIG. 1*e* is a top view of the lid shown in FIG. 1*d;*

In FIG. 1*a* I have shown an upwardly open housing 10 whose rectangular outline corresponds, substantially, to that of an associated lid 30 illustrated in FIGS. 1*d* and 1*e*. Housing 10 is formed at its top with an inner peripheral rabbet 14 for the alternative seating of the lid 30 or of an extension of similar outline such as a shell 16 (FIGS. 1*b* and 7) or 23 (FIG. 1*c*). A nipple 11 forms an exit port in the upper part of the right-hand sidewall of housing 10 and is tilted slightly downwardly for connection to a nonillustrated sewer pipe. Underneath that exit port the sidewall forms an upwardly open pocket 13 bounded by a lip 10*a* adapted to enter a pair of complementary notches in the bottom edge of a removable insert as described hereinafter. Screw bolts 12 (only one shown) on opposite sides of a vertical plane of symmetry, bisecting the exit port 11, have portions firmly and fluidtightly embedded in the plastic material of the housing wall and are designed to pass inwardly through respective mounting holes on a flange of the insert as more fully described in my U.S. Pat. No. 4,092,747 referred to above. See also FIGS. 2–4 and 6.

Figure 7:
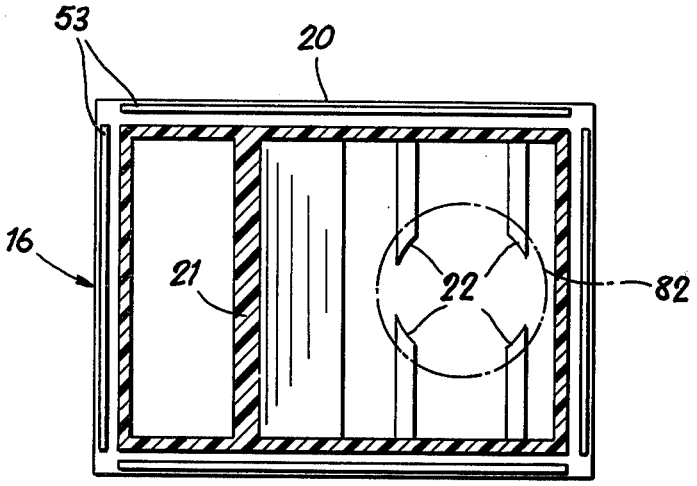
FIG. 7 is a cross-sectional view taken on the line VII—VII of FIG. 1*b*.

The top of housing 10 is further provided, at the level of its rabbet 14, with an outer peripheral flange 15 designed to facilitate the establishment of a rigid and fluidtight connection between the housing and a shell 16 or 23 fitted thereto. For this purpose, each of these shells is formed near its lower end with a similar outer peripheral flange 20 overlying the flange 15 when the bottom edge 17 of the shell is received in the rabbeted top of the housing. The shell and the housing can then be interconnected by a set of fasteners such as one-piece C-clamps 52 illustrated in FIG. 1*g*. For a more positive connection, as seen in FIGS. 1*g* and 7, flanges 15 and 20 can be provided on their mutually averted surfaces with edge beads 53 which terminate short of the corners of the rectangular housing and shell profiles to facilitate the emplacement of the clamps. Thus, the confronting jaws of a clamp 52 can be inserted through one of the corner gaps between beads 53 whereupon the clamps may be shifted along one of the sides of the rectangle to let their jaws reach around these beads and firmly grip the two flanges 15 and 20. The clamps, if suitably dimensioned to engage these flanges with a tight frictional fit, may be of unitary construction with fixed jaws as shown; this simplifies assembly and disassembly, yet the components could also be interconnected by adjustable fasteners.

The two shells 16 and 23 differ from each other only in their height, shell 23 (FIG. 1*c*) being considerably taller than shell 16 (FIG. 1*b*). Each shell is formed at its top with an inner rabbet 18, similar to the rabbet 14 of housing 10, designed to receive the lid 30 or another extension shell to increase the height of the assembly. Rabbet 18 is surrounded by an outer peripheral flange 19 which is generally similar to housing flange 15 and facilitates the interconnection of several shells in the afore-described manner. Moreover, the shells are externally provided with peripheral reinforcing ribs 24 at levels between upper and lower flanges 19 and 20.

The components 10, 16 and 23 are all nearly prismatic but have a slight downward draft to make their bottom ends fit snugly into the rabbeted top of any other component for stacking purposes. Thus, even the housing 10 could be supported on a shell 16 or 23 if it were desired to raise the trap proper above the bottom of its well.

A downwardly sloping shelf 21 extends from the left-hand sidewall of either shell 16, 23 (as viewed in FIGS. 1*b* and 1*c*) toward the center of the shell so as to form a deflector for pebbles or other solid objects dropping through perforations 34 (see FIG. 1*e*) in the overlying half of lid 30. The opposite, right-hand shell half is provided with a set of inwardly extending lugs 22 for the suspension of a removable filter screen in the shape of a basket 82 (FIGS. 4–6) designed to catch these solids.

As shown in FIGS. 1*d* and 1*e*, lid 30 is split into two disjointed halves 31, 32. Its left-hand half 31 is formed with a circular recess 33 accommodating a conduit 90, e.g. a leader descending from an eave of a building, carrying waste water to be discharged into the exit port 11 (FIG. 1*a*) of housing 10. The right-hand half 32 of the lid, also provided with perforations 34, has a countersunk grip 35 facilitating its removal from the housing or the shell on which it has been deposited. If no direct connection to an inlet pipe is required, the lid 30 may be replaced by a unitary lid 30' lacking the recess 33, e.g. as shown in FIGS. 2–4 and 6; only one half of lid 30' has perforations 34.

Figure 1F:
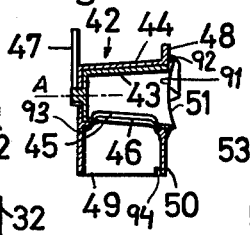
FIG. 1*f* is a longitudinal sectional view of an insert for an anti-backup trap, receivable in the housing of FIG. 1*a;*
Figure 1G:
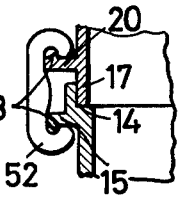
FIG. 1*g* is a fragmentary sectional view, drawn to a larger scale, of two interfitted components held together by a clamp.

In FIG. 1*f* I have shown a tubular insert 42 receivable in the right-hand half of housing 10 (FIG. 1*a*) in order to form an odor trap and an anti-backup seal. Such an insert has been more fully described in my U.S. Pat. No. 4,074,686 whose disclosure is hereby incorporated by reference in the present application. For purposes of the instant description it is sufficient to note that the insert is a tubular conduit with a bottom inlet 49 and a lateral outlet 91 closable by a check valve in the form of a flap 51 hinged to the conduit at 92. A hollow frustoconical valve body 43, centered on a horizontal axis A, is rotatable about that axis with the aid of a handle 47 and is received in a complementarily frustoconical seat formed by the top wall 44 of the insert and by a generally horizontal partition 93. Valve body 43 and partition 93 are formed with coextensive cutouts 45, 46 which can be moved into and out of register by a swinging of handle 47 through an angle of about 90°. Insert 42 has a vertical flange 48 with mounting holes designed to receive the bolts 12 of housing 10 (FIG. 1*a*) for aligning its outlet 91 with port 11, the flap 51 being free to swing outwardly into that port; a depending foot portion 50 of the insert in line with flange 48 fits into the pocket 13 of the housing, an adjacent cutout 94 then receiving the lip 10*a*.

Figure 1H:
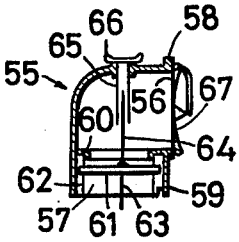
FIG. 1*h* is a view similar to FIG. 1*f,* showing another insert designed for an odor trap and receivable in the housing of FIG. 1*a;*

FIG. 1*h* shows an insert 55 designed to serve the same purpose as the insert 42 of FIG. 1*f*. Insert 55, has a flange 58 surrounding an outlet 56 which is closable by a hinged flap 67 serving as a check valve. A horizontal partition 60 in the lower part of insert 55 has an opening closable by a valve disk 61 which is held against rotation by vertical inner ribs 62 and is integral with a lead-screw 64 engaged by a tubular nut 65 journaled in the top of the insert. Rotation of a handwheel 66, rigid with nut 65, enbles the disk 61 to be lowered or raised, the lower limit of its stroke being determined by a depending stem 63 coming to rest on the housing bottom. Normally, as illustrated in FIG. 1*h*, the disk is spaced from the partition 60 and allows water to flow from an inlet 57 to outlet 56 through a peripheral clearance separating that disk from the surrounding wall, the cross-section of this flow path being preferably at least equal to that of the outlet in order to prevent any congestion. When the disk 61 is raised against a seat on the underside of partition 60, the flow is cut off to prevent any backup from exit port 11 into the interior of the housing. A depending foot portion 59, which corresponds to the foot portion 50 of insert 42, is aligned with the upstanding flange 58 engageable by bolts 12 (see FIG. 3) and is receivable in pocket 13 of housing 10. For a more detailed description, reference is again made to my U.S. Pat. No. 4,074,686.

In FIG. 1*i* I have shown an insert 36 for an odor trap, again with a bottom inlet 39 and a side outlet 37. An upwardly concave tongue 38 defines a restricted channel with the vertical peripheral wall of the insert, the edge of the tongue rising to almost the horizontal midplane H of outlet 37. This outlet, again, is surrounded by a vertical flange 40 designed to rest closely against the right-hand sidewall of housing 10 (FIG. 1*a*), with interposition of a nonillustrated packing ring, and to receive its mounting bolts 12. A depending foot portion 41 (see FIG. 2) is receivable in the pocket 13 of that sidewall and is in line with flange 40. Further details of insert 36 have been described in my U.S. Pat. No. 4,092,747 whose disclosure is hereby incorporated, by reference, in the present application.

Figure 2:
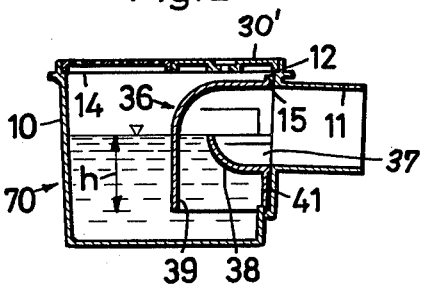
FIG. 2 is a longitudinal sectional view of an odor trap including the components of FIGS. 1*a*, 1*d*, 1*e* and 1*i*.

FIG. 2 shows an odor trap 70 assembled from the modular components 10, 36 and 30'. The water level within insert 36 is shown to have a height h, determined by the upper edge of tongue 38, which should be at least equal to the diameter of outlet 37 and exit port 11. The absolute magnitude of height h may be 10 cm or more.

Figure 3:
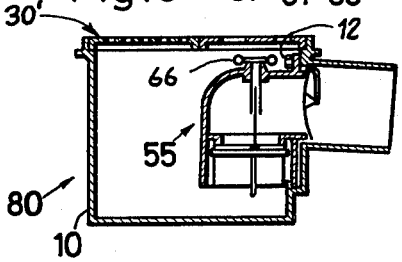
FIG. 3 is a view similar to FIG. 2 but showing an anti-backup trap with an insert as shown in FIG. 1*h*.

FIG. 3 illustrates an anti-backup trap 80 assembled from components 10, 30' and 55. The handwheel 66 of insert 55 is accessible upon removal of the lid 30'.

Figure 4:
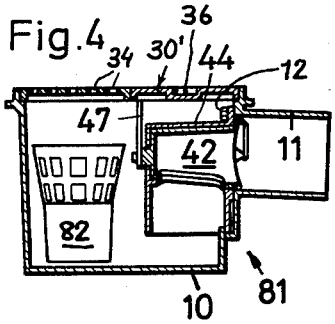
FIG. 4 is a view like FIG. 3, showing the insert of FIG. 1*f* substituted for the one of FIG. 1*h*.

FIG. 4 shows a similar trap 81 with substitution of insert 42 for insert 55. Lever 47 can be manipulated upon removal of lid 30'.

In all three instances represented by FIGS. 2–4, the insert leading to the exit port occupies only the right-hand half of the housing 10 whose left-hand half serves as an antechamber. This antechamber may be left empty, as illustrated in FIGS. 2 and 3, or may be occupied by a removable catch basket 82 for the aforedescribed purpose.

Figure 5:
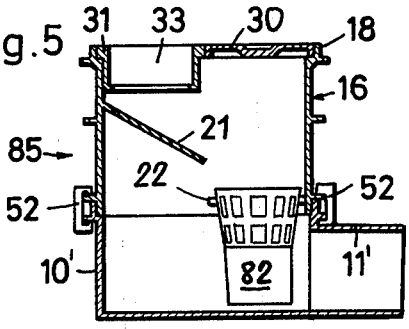
FIG. 5 is a longitudinal sectional view of a different housing extended upwardly by the shell shown in FIG. 1*b*.

In FIG. 5 I have depicted a trap 85 comprising a modified housing 10' whose exit port 11' is disposed just above its bottom. The housing is extended upwardly by a shell 16, cf. FIG. 1*b*, topped by a removable lid 30. A basket 82 in the right-hand half of housing 10' is suspended from lugs 22 of shell 16 for intercepting solid objects deflected toward it by the sloping shelf 21. Clamps 52 are shown holding the housing 10' and the shell 16 together in the manner described above.

Figure 6:
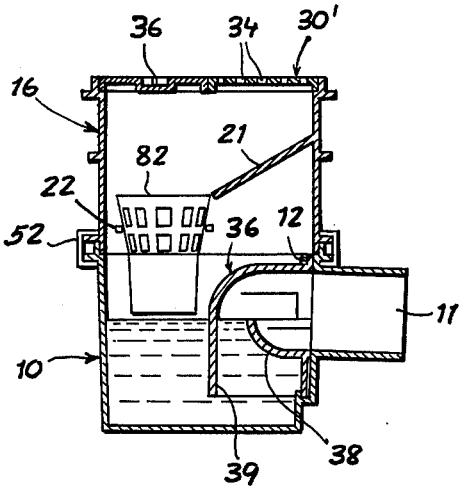
FIG. 6 is a view similar to FIG. 5 but showing the trap of FIG. 2 extended by the shell of FIG. 1*b*.

In FIG. 6, finally, the shell 16 overlain by lid 30' is mounted on the housing 10 of FIGS. 1*a* and 2, equipped with the insert 36 forming an odor seal. In this instance the shelf 21 overlies the insert 36, with basket 82 suspended alongside the insert in the left-hand part of the assembly. Naturally, insert 36 may be replaced by any of the other inserts described above, either originally or after installation.

The lid 30' has been shown so positioned in FIG. 6 that its perforated right-hand section overlies the shelf 21 whereby stones or other solids dropping through the perforations 34 will first hit the shelf so that the basket 82 will not be damaged by the impact. If this lid is replaced by the split lid 30, the recessed half 31 ought to be positioned above the shelf 21 as in FIG. 5.

If the stacked components such as the housing 10 and the shell 16 of FIG. 6 are to remain permanently connected, their interfitting surfaces may be coated with a suitable water-insoluble adhesive also serving as a sealant. In that case the clamps 52 or their equivalents need not be used or may be removed after the bonding agent has hardened. Alternatively, these surfaces may be fitted with conventional packing rings (not shown) deforming under the clamping pressure to provide a fluid-tight seal therebetween.

The separability of the disjointed sections 31 and 32 of lid 30 affords access to the interior of the trap housing without requiring the removal of the lid half 31 to which a stationary pipe 90 or the like has been attached.

Naturally, the described modular components need not have the exact shape shown in the drawing. Thus, for example, their cross-sections may be rounded rather than rectangular or square. The divided lid 30 may be used with any embodiment.

I claim:

1. A modular assembly for a drain trap, comprising:

an upwardly open housing of substantially prismatic shape with a generally rectangular horizontal outline having a sidewall provided with an exit port for waste water accumulated therein, said sidewall defining one of the minor sides of the rectangle and being internally formed below said exit port with a pocket open toward the top;

a tubular insert having a closed top, a bottom inlet and a side outlet, said insert having a width substantially smaller than that of said housing in a direction parallel to the major sides of the rectangle and being provided with a depending foot portion adjacent said sidewall receivable in said pocket for juxtaposing said insert in said housing with said sidewall in a position of alignment of said outlet with said exit port, said insert being further provided at said closed top with an upstanding flange in line with said foot portion; and inwardly extending ancillary fastening means on said sidewall above said exit port engageable with said flange for securing said insert to said housing in cantilevered position on said sidewall.

2. A modular assembly as defined in claim 1 wherein said ancillary fastening means comprises a pair of screw bolts projecting inwardly from said sidewall on opposite sides of said exit port, said closed top being provided with an upstanding flange surrounding said outlet and having mounting bolts alignable with said bolts for penetration thereby.

3. A modular assembly as defined in claim 1 wherein said housing has one half proximal to said sidewall accommodating said insert and another half remote from said sidewall forming an antechamber for inflowing water.

4. A modular assembly as defined in claim 3, further comprising a lid for said housing with a first section overlying said one half and a second section overlying said other half, said first section being provided with a recessed grip, said second section having perforations for the admission of water to said antechamber.

5. A modular assembly as defined in claim 4 wherein said sections are disjointed from each other, said second section being provided with a depression for a discharge duct.

6. A modular assembly as defined in claim 3 further comprising a shell secured to the open top of said housing as an extension thereof.

7. A modular assembly as defined in claim 6 wherein said housing is formed at its top with an inner peripheral rabbet and a first outer peripheral flange, said shell being receivable on said rabbet and being provided at its bottom with a second outer peripheral flange, further comprising clamping means engageable with said flanges for securing said shell to said housing.

8. A modular assembly as defined in claim 7 wherein said first flange has a lower surface and said second flange has an upper surface each provided with an edge bead, said clamping means comprising a one-piece yoke with confronting lower and upper jaws reaching around said edge beads.

9. A modular assembly as defined in claim 8 wherein said first and second flanges are generally rectangular, said edge beads extending all around said first and second flanges but being interrupted at the corners of the rectangle to facilitate insertion of said lower and upper jaws.

10. A modular assembly as defined in claim 6 wherein said shell is internally provided with supporting means for removably holding a catch basket in a part of said shell overlying said antechamber, further comprising a deflector in said shell positioned to overlie said insert while sloping downwardly toward said catch basket.

11. A modular assembly as defined in claim 1 wherein said housing and said insert are unitary bodies of tough, corrosion-resistant plastic material, said fastening means comprising screw bolts with portions embedded in the material of said sidewall.

12. A modular assembly as defined in claim 1 wherein said insert is internally provided with an upwardly concave tongue integral with said foot, said tongue rising from a bottom edge of said outlet to a level close to a horizontal midplane of said outlet.

* * * * *